US009180337B2

(12) United States Patent
Chia et al.

(10) Patent No.: US 9,180,337 B2
(45) Date of Patent: Nov. 10, 2015

(54) SUPPORT FRAME FOR EXERCISE APPARATUS

(71) Applicant: REXON INDUSTRIAL CORP., LTD., Taichung (TW)

(72) Inventors: Benjamin Chia, San Jose, CA (US); Yi-Chun Liao, Taichung (TW)

(73) Assignee: REXON INDUSTRIAL CORP., LTD., Taichung (TW)

( * ) Notice: Subject to any disclaimer, the term of this patent is extended or adjusted under 35 U.S.C. 154(b) by 277 days.

(21) Appl. No.: 13/854,431

(22) Filed: Apr. 1, 2013

(65) Prior Publication Data

US 2013/0260966 A1 Oct. 3, 2013

Related U.S. Application Data

(60) Provisional application No. 61/618,905, filed on Apr. 2, 2012.

(30) Foreign Application Priority Data

Apr. 2, 2012 (TW) ..... 101111709 A

(51) Int. Cl.
*A63B 22/00* (2006.01)
*A63B 71/00* (2006.01)
(Continued)

(52) U.S. Cl.
CPC ..... *A63B 23/0476* (2013.01); *A63B 22/0046* (2013.01); *A63B 22/0605* (2013.01); *A63B 22/0015* (2013.01); *A63B 2022/0652* (2013.01); *A63B 2208/0233* (2013.01)

(58) Field of Classification Search
CPC ..... A63B 22/06; A63B 23/0476; A63B 22/0605; A63B 22/0046; A63B 22/0015; A63B 2022/0652; A63B 2208/0233; A63B 22/0635; A63B 22/0641; A63B 2022/0647; A63B 22/0087; A63B 22/0048; A63B 22/0064; A63B 22/0664
USPC ..... 482/51–53, 57–69, 72–73, 78, 131–139
See application file for complete search history.

(56) References Cited

U.S. PATENT DOCUMENTS 2,145,940 A * 2/1939 Marlowe ..... 482/72
3,578,800 A * 5/1971 DiNepi ..... 482/57
(Continued)

FOREIGN PATENT DOCUMENTS

FR 2440753 A * 7/1980
GB 2361651 A * 10/2001
(Continued)

*Primary Examiner* — Oren Ginsberg
*Assistant Examiner* — Joshua Lee
(74) *Attorney, Agent, or Firm* — Bacon & Thomas, PLLC

(57) ABSTRACT

A support frame for an exercise apparatus includes a base providing a fulcrum, and a moving arm member having a rotating portion located at one end thereof, and a swinging portion located at an opposite end thereof and equipped with a seat unit. The rotating portion is equipped with a wheel pedal unit and is rotatably supported on the fulcrum of the base. The swinging portion is swingable on the center of the rotating portion between a high position located far apart from the base, and a low position located in closer proximity to the base. The support frame is configurable to change the elevation difference between the seat unit and the wheel pedal unit in both a vertical direction and a horizontal direction. Thus, the elevation difference is relatively changed by means of moving the moving arm member relative to the base. This causes the relative position between the wheel pedal unit and the seat unit to change for allowing the user to exercise in a normal upright, or elevated, sitting exercise mode or a recumbent sitting exercise mode.

19 Claims, 9 Drawing Sheets

(51) Int. Cl.

| | |
|---|---|
| ***A63B 22/06*** | (2006.01) |
| ***A63B 69/16*** | (2006.01) |
| ***A63B 22/12*** | (2006.01) |
| ***A63B 21/068*** | (2006.01) |
| ***A63B 23/04*** | (2006.01) |

(56) References Cited

U.S. PATENT DOCUMENTS

| | | | | |
|---|---|---|---|---|
| 3,727,608 | A * | 4/1973 | Simsian | 601/146 |
| 3,910,571 | A * | 10/1975 | Stenn | 482/60 |
| 4,796,882 | A * | 1/1989 | Jiumr | 482/57 |
| 5,178,593 | A * | 1/1993 | Roberts | 482/62 |
| 5,549,527 | A * | 8/1996 | Yu | 482/57 |
| 5,782,639 | A * | 7/1998 | Beal | 434/29 |
| 5,951,447 | A * | 9/1999 | Butler | 482/111 |
| 6,001,071 | A * | 12/1999 | Butler | 601/36 |
| 6,071,215 | A | 6/2000 | Raffo et al. | |
| 6,551,219 | B1 * | 4/2003 | Brown | 482/57 |
| 6,692,411 | B1 * | 2/2004 | Stearns et al. | 482/57 |
| 6,926,645 | B1 * | 8/2005 | Stearns et al. | 482/62 |
| 7,097,598 | B2 * | 8/2006 | Lee | 482/57 |
| 7,393,308 | B1 * | 7/2008 | Huang | 482/51 |
| 7,758,475 | B2 * | 7/2010 | Goldberg | 482/62 |
| 7,819,782 | B2 * | 10/2010 | Yamazaki | 482/73 |
| 7,867,146 | B2 * | 1/2011 | Ge et al. | 482/51 |
| 8,062,190 | B2 * | 11/2011 | Pyles et al. | 482/57 |
| 8,062,192 | B1 * | 11/2011 | Arstein | 482/57 |
| 2002/0004439 | A1 * | 1/2002 | Galbraith et al. | 482/57 |
| 2002/0016236 | A1 * | 2/2002 | Stearns et al. | 482/57 |
| 2004/0259694 | A1 * | 12/2004 | Yang | 482/63 |
| 2005/0239608 | A1 * | 10/2005 | Somwong | 482/57 |
| 2008/0085819 | A1 | 4/2008 | Yang | |
| 2009/0197744 | A1 * | 8/2009 | Yamazaki | 482/57 |
| 2010/0130331 | A1 * | 5/2010 | Hu | 482/57 |
| 2012/0115695 | A1 * | 5/2012 | Watterson et al. | 482/142 |
| 2013/0130798 | A1 * | 5/2013 | Nir et al. | 463/36 |

FOREIGN PATENT DOCUMENTS

| | | | |
|---|---|---|---|
| JP | 3143723 U | * | 7/2008 |
| TW | I299668 B | | 8/2008 |

* cited by examiner

SUPPORT FRAME FOR EXERCISE APPARATUS

CROSS REFERENCE TO RELATED APPLICATION(S)

This application claims, under 35 U.S.C. §119(e), priority to U.S. Provisional Application No. 61/618,905, filed Apr. 2, 2012, which application is hereby incorporated by reference in its entirety, inclusive of the specification, claims, and drawings.

FIELD OF THE INVENTION

The present invention relates to an exercise apparatus and more particularly, to a support frame for an exercise apparatus, which allows exercises in different exercising postures.

BACKGROUND

Referring to FIGS. 1 and 2, U.S. Pat. No. 6,071,215 discloses a multi-mode exercise machine 1, which includes an exercise base station 11, a pedal unit 12 mounted to the exercise base station 11, a cycle seat 13 supported on the pedal unit 12, an arm 14 pivotally mounted to the exercise base station 11 at one side relative to the pedal unit 12. Handlebars 15 are mounted to one end of the arm 14, and a second seat 16 is slidably coupled to the arm 14. A receivable pull rope unit 17 is pivotally mounted to the pedal unit 12, and a footrest unit 18 is pivotally mounted to the other end of the arm 14. The pull rope unit 17 includes a pull rope 171 passing around a guide roller inside the pedal unit 12, and a pull bar 172 connected to one end of the pull rope 171 and disposed outside the pedal unit 12.

When the arm 14 is set in a vertical position, a user can sit on the cycle seat 13 and hold the handlebars 15 with their hands, and then operate the pedal unit 12 with their feet for performing a first exercise mode. Alternatively, when the arm 14 is set in a horizontal position, the user can sit on the second seat 16 in a recumbent posture to hold the pull bar 172 with their two hands and then place their feet in the foot rest unit 18. By means of pulling up or letting off the pull rope 171, the second seat 16 is moved along the arm 14 for performing a second exercise mode.

The aforesaid prior art multi-mode exercise machine 1 can provide both upright and recumbent exercise modes. However, it must provide two seats (the cycle seat 13 and the second seat 16), two handles (the handlebars 15 and the pull bar 172) and two foot portions (the pedal unit 12 and the foot rest unit 18). Including two versions of each of these components disadvantageously complicates the structure and operation of this prior art exercise machine 1.

SUMMARY OF THE INVENTION

The present invention has been accomplished under the circumstances in view. It is the main object of the present invention to provide a support frame for an exercise apparatus, which has a simple structure that facilitates operation, and which allows a user to easily change exercise modes.

To achieve this and other objects of the present invention, a support frame is used in an exercise apparatus having a wheel pedal unit for pedaling by the legs of a user, and a seat unit to accommodate sitting by the user. The support frame comprises a base that provides at least one fulcrum. The support frame also comprises a moving arm member having a rotating portion located at one end thereof and rotatably supported on the at least one fulcrum of the base, and a swinging portion located at an opposite end thereof. The rotating portion further includes the wheel pedal unit installed therein, and the swinging portion includes the seat unit installed therein. In order to change the elevation difference, i.e. the distance, between the seat unit and the wheel pedal unit in both the vertical and horizontal directions, the swinging portion is preferably swingable on the center of the rotating portion between a high position located far away from the base, and a low position located closer toward the base.

In view of the above, there are numerous benefits of moving the moving arm member relative to the base to change the elevation difference between the first and second ends of the moving arm member. For example, the relative position between the wheel pedal unit and the seat unit may be relatively changed, thus allowing the user to perform a first exercise mode in a normal upright sitting position or a second exercise mode in a recumbent sitting position.

BRIEF DESCRIPTION OF THE DRAWINGS

These and other features, aspects, and advantages of the present disclosure will become better understood with regard to the following description, appended claims, and accompanying drawings.

Figure 1:
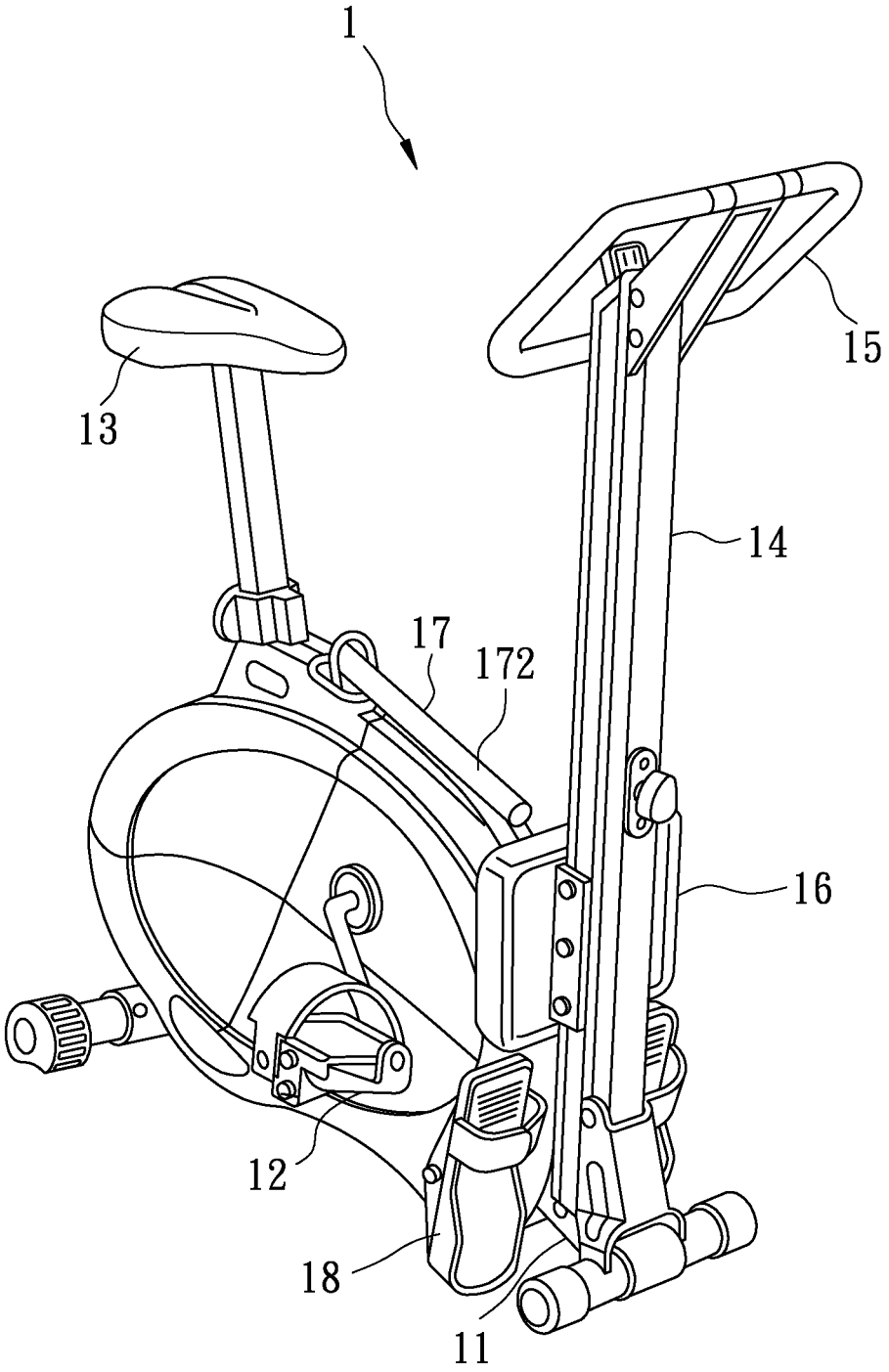
FIG. 1 PRIOR ART
FIG. 1 is a perspective view of a conventional multi-mode exercise machine.
Figure 2:
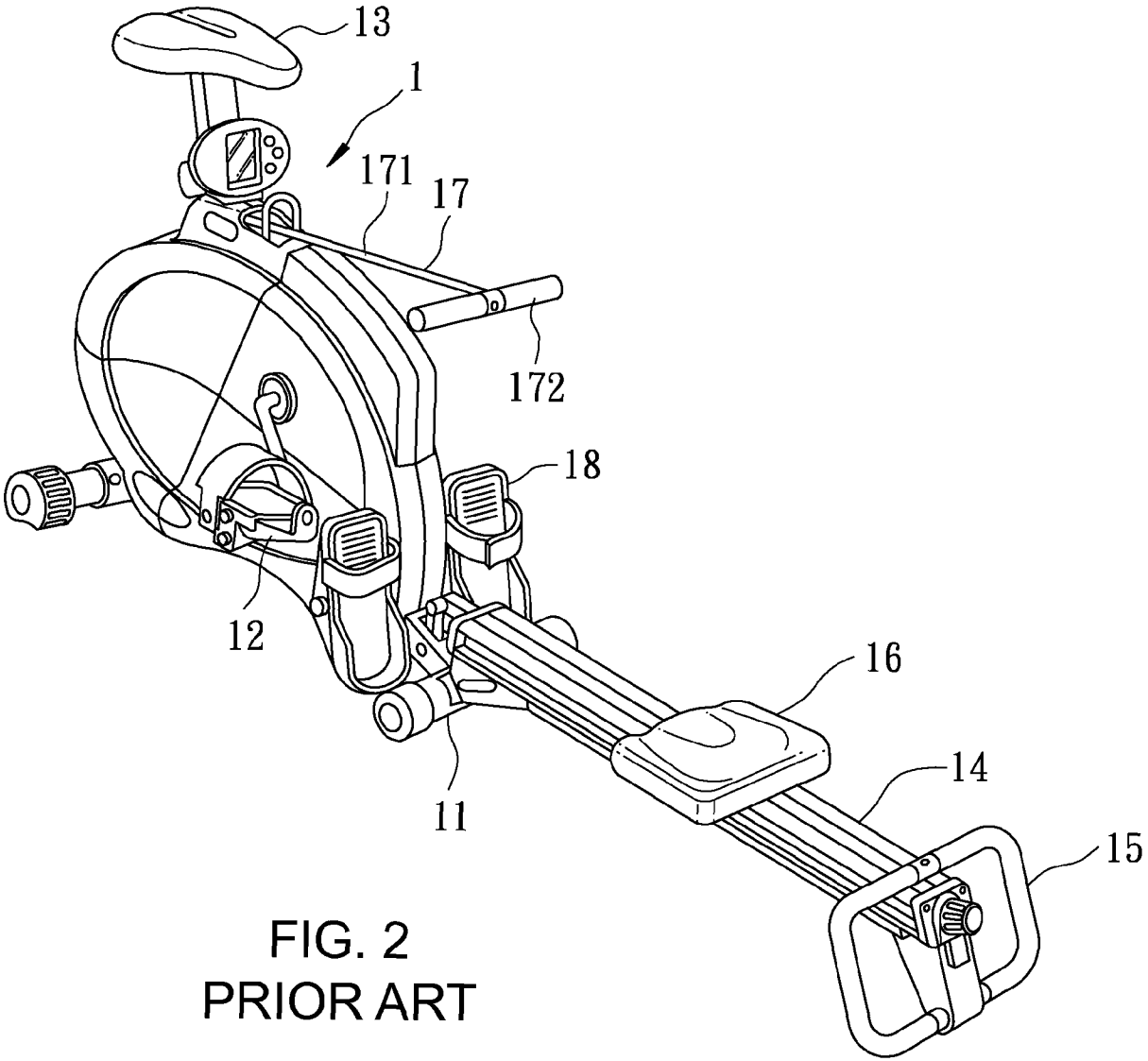
FIG. 2 PRIOR ART
FIG. 2 is another perspective view of the conventional exercise machine of FIG. 1, illustrating the arm changed from the vertical position to the horizontal position.

It should be noted that the drawing figures are not necessarily drawn to scale, but instead are drawn to provide a better understanding of the components thereof, and are not intended to be limiting in scope, but rather to provide exemplary illustrations. It should further be noted that the figures illustrate exemplary embodiments of a support frame for an exercise apparatus and the components thereof, and in no way limit the structures or configurations of a support frame for an exercise apparatus and components thereof according to the present disclosure.

DETAILED DESCRIPTION OF THE INVENTION

Other and further advantages and features of the present invention will be understood by reference to the following specification in conjunction with the accompanying drawings.

While the disclosure may be susceptible to various modifications and alternative constructions, certain illustrative embodiments are shown in the drawings and are described in detail below. It should be understood, however, that there is no intention to limit the disclosure to the specific embodiments disclosed, but on the contrary, the intention is to cover all modifications, alternative constructions, combinations, and equivalents falling within the spirit and scope of the disclosure.

It will be understood that, unless a term is expressly defined in this disclosure to possess a described meaning, there is no intent to limit the meaning of such term, either expressly or indirectly, beyond its plain or ordinary meaning.

Figure 3:
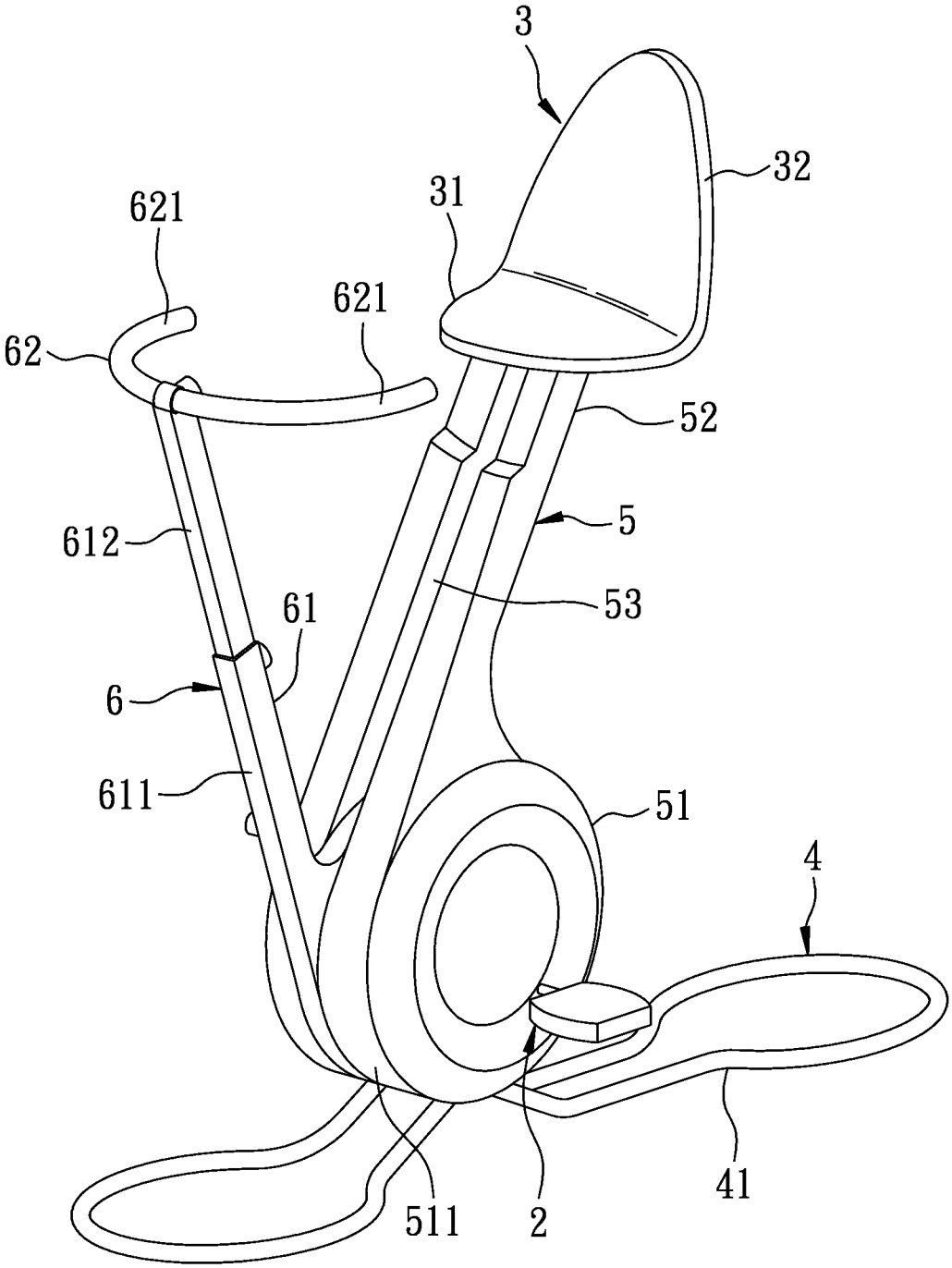
FIG. 3 is a front perspective view illustrating a support frame used in an exercise apparatus in accordance with a first embodiment of the present invention.
Figure 4:
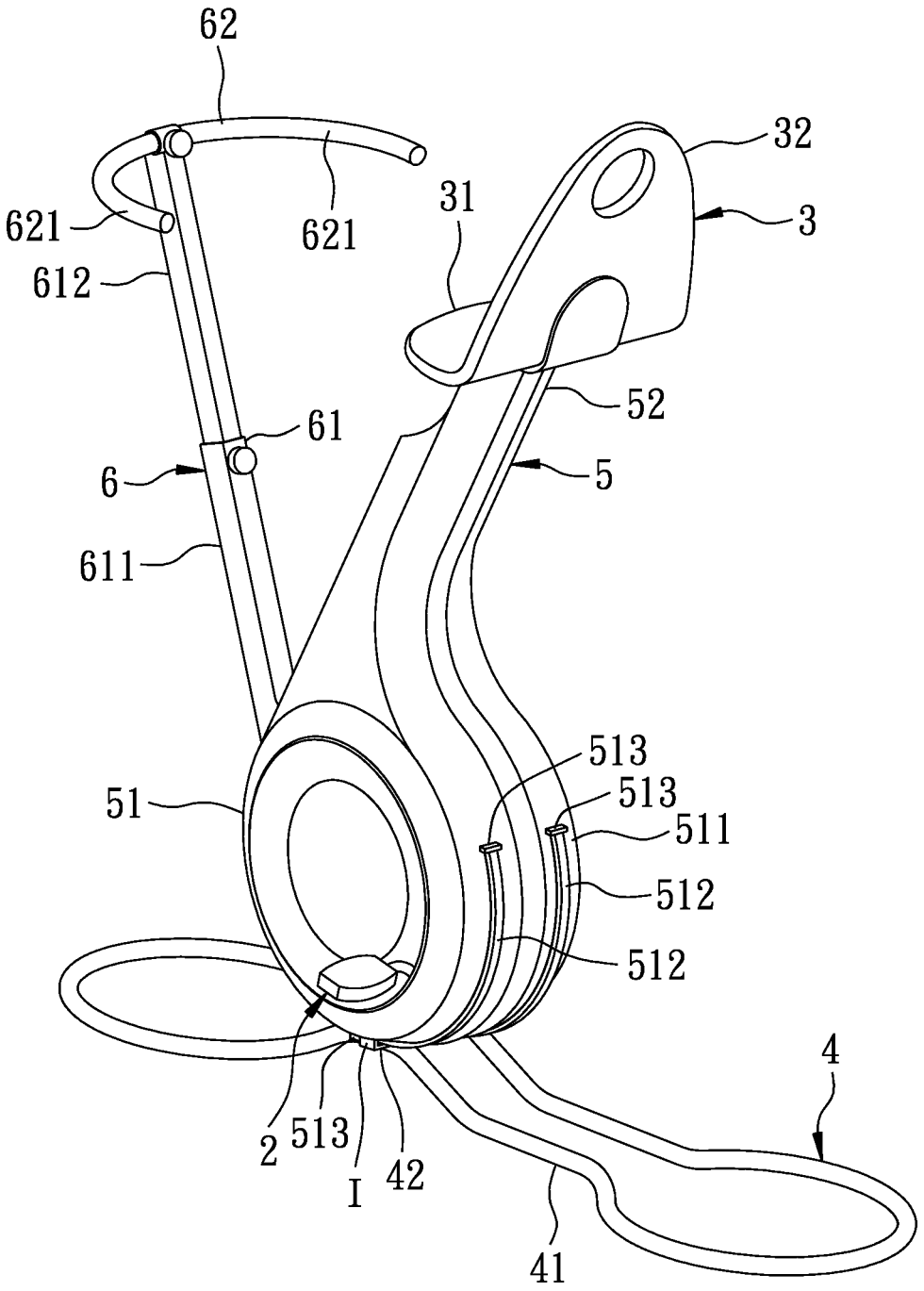
FIG. 4 is a rear perspective view of the first embodiment of the present invention, illustrating an increased elevation difference in the vertical direction and a reduced elevation difference in the horizontal direction.
Figure 5:
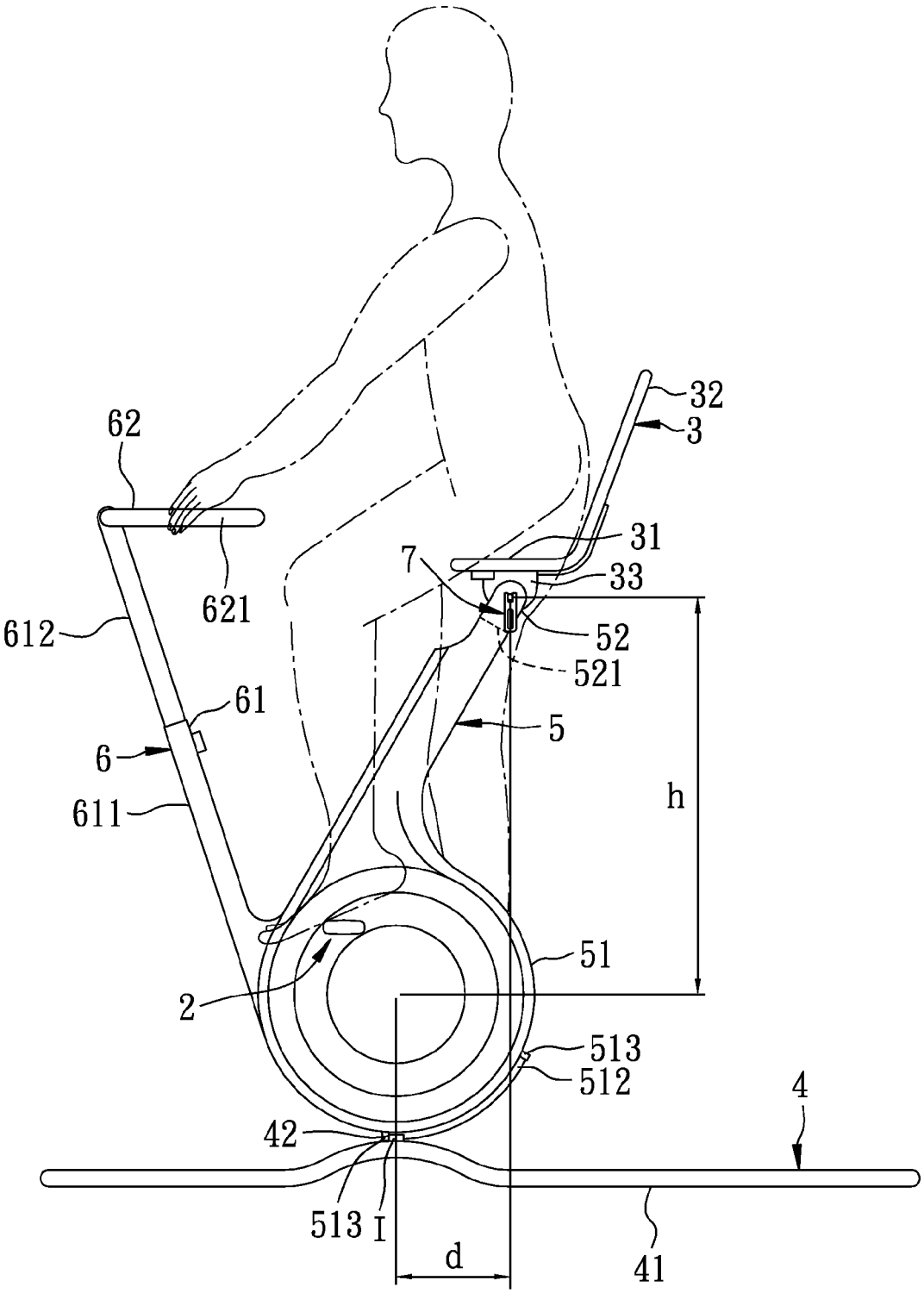
FIG. 5 is a schematic front view of the first embodiment of the present invention, illustrating a user sitting on the seat unit in a normal upright sitting position.

Referring to FIGS. 3 through 5, a support frame for an exercise apparatus in accordance with a first embodiment of the present invention is shown assembled with a wheel pedal unit 2 and a seat unit 3. The wheel pedal unit 2 is configured for pedaling by a user's two legs. The seat unit 3 comprises a seat 31, a back cushion 32, and a mounting portion 33 located at the bottom side of the seat cushion 31. In this embodiment, the mounting portion 33 may be a protruded member extending from the bottom side of the seat 31. The support frame comprises a base 4, a moving arm member 5, a handle assembly 6, and a quick release 7.

The base 4 comprises a body 41, and two rail supports 42 arranged at the top side thereof to work as a fulcrum I. The rail supports are placed on the body 41 apart from each other at a predetermined distance.

The moving arm member 5 comprises a rotating portion 51 located at one end thereof, a swinging portion 52 located at an opposite end thereof, and a recessed portion 53 located therebetween. The aforesaid wheel pedal unit 2 is mounted in the rotating portion 51. The rotating portion 51 defines an arched wall 511 extending around an axis, two rails 512 extending along the outer surface of the arched wall 511 and respectively slidably coupled to the rail supports 42, and four stop blocks 513 respectively located at the two opposite ends of each rail 512. The swinging portion 52 has its one end terminating in a connection means 521. In this embodiment, the connection means 521 may be a recess for pivotally accommodating the mounting portion 33 of the seat unit 3.

Figure 6:
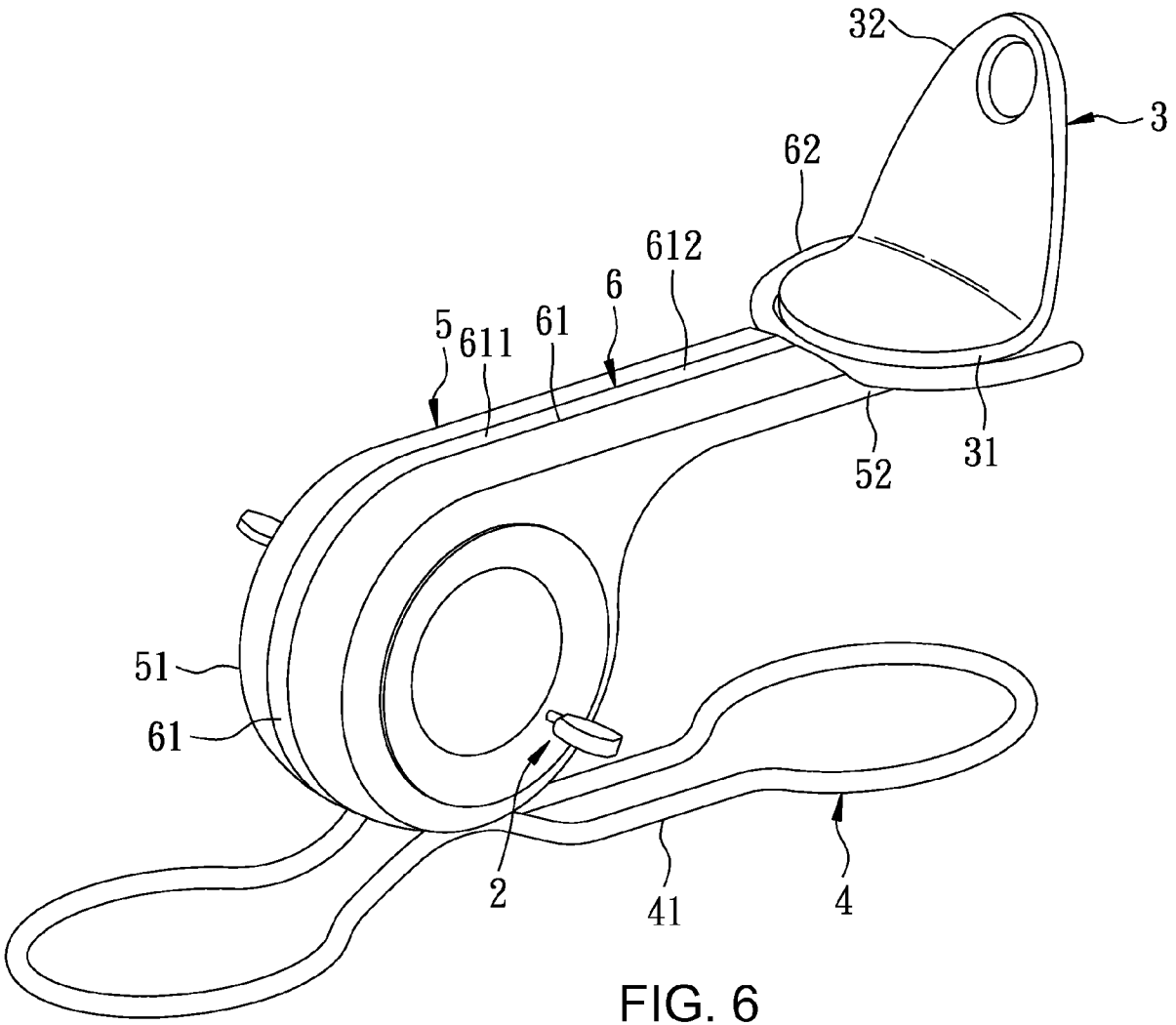
FIG. 6 is a front perspective view of the first embodiment of the present invention, illustrating a reduced elevation difference in the vertical direction and an increased elevation difference in the horizontal direction.
Figure 7:
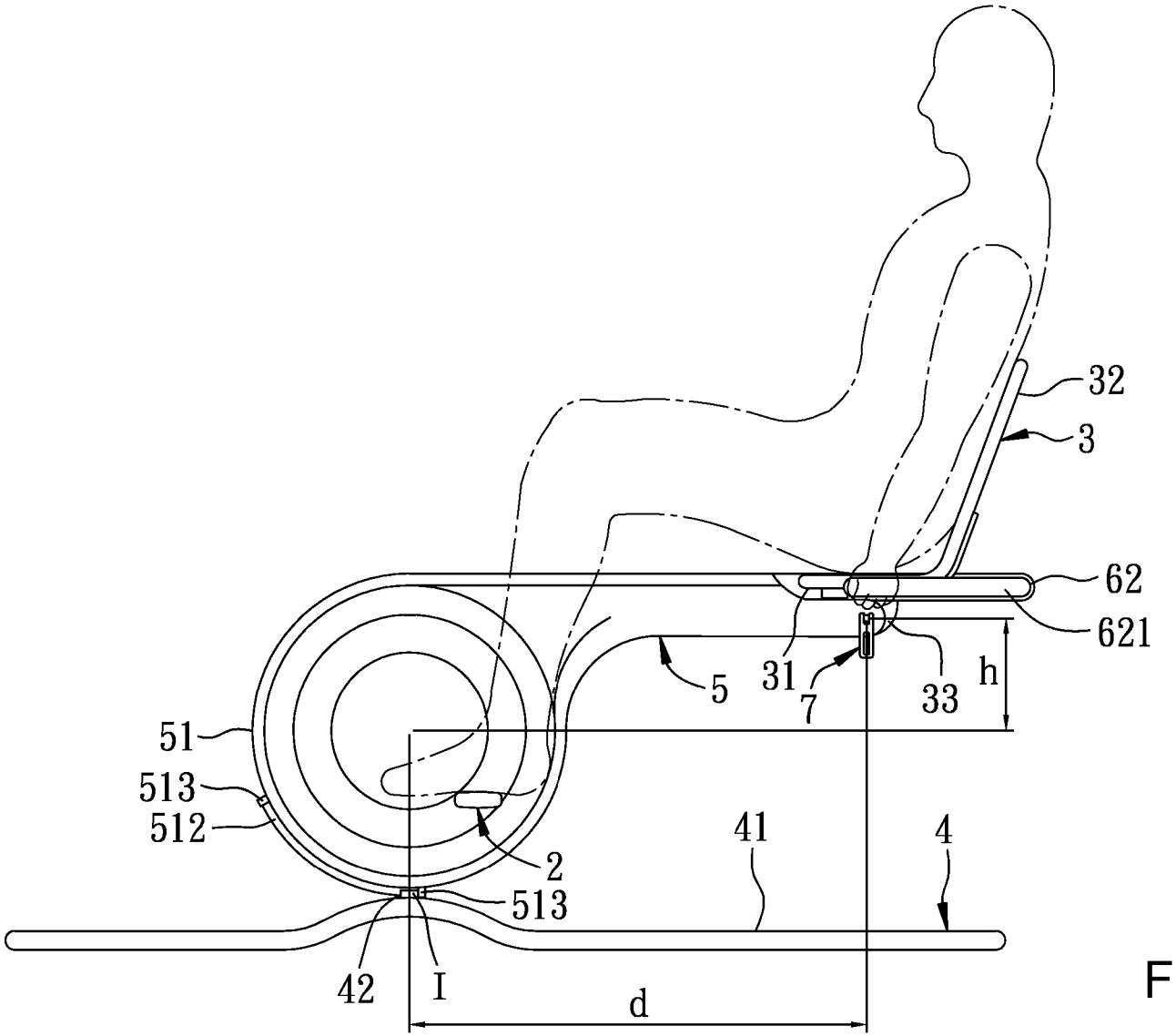
FIG. 7 is a schematic front view of the first embodiment of the present invention, illustrating a user sitting on the seat unit in the recumbent sitting position.

It is worth mentioning that, subject to movement of the arched wall 511 relative to the rail supports 42, the swinging portion 52 may be moved with the rotating portion 51 on the fulcrum I between a high position located farther away from the base 4 (see FIGS. 3 through 5), and a low position located in closer proximity to the base 4 (see FIGS. 6 and 7). This movement causes both the elevation difference h between the rotating portion 51 and the swinging portion 52 in the vertical direction, as well as the elevation difference d between the rotating portion 51 and the swinging portion 52 in the horizontal direction, to be relatively changed.

The handle assembly 6 comprises a retractable support 61, and a handlebar 62 fastened to the retractable support 61 for holding by the user's hands. The retractable support 61 can be received in the recessed portion 53 of the moving arm member 5, and comprises a sleeve 611 pivotally connected to the rotating portion 51 of the moving arm member 5. The retractable support 61 further comprises an inner bar 612 movable in and out of the sleeve 611 and connected to the handlebar 62. The handlebar 62 is a smoothly arched rod member, defining two backwardly extending grips 621. The gap defined between the two grips 621 is preferably larger than the width of the seat cushion 31.

The quick release 7 is pivotally inserted through the connection means 521 of the moving arm member 5 and the mounting portion 33 of the seat unit 3. Moreover, the quick release 7 is operable to lock and unlock the connection means 521 and the mounting portion 33. For example, unlocking allows the seat unit 3 to be rotated along with the mounting portion 33 relative to the connection means 521 of the moving arm member 5, while locking conversely locks the seat unit 3 to the moving arm member 5 in the selected position.

During application, the handle assembly 6 can be moved relative to the moving arm member 5 between a first position where the sleeve 611 and the inner bar 612 are received in the recessed portion 53 of the moving arm member (see FIGS. 6 and 7), and a second position where the handle assembly 6 is kept far from the moving arm member 5 (see FIGS. 3 through 5). Further, when the handle assembly 6 is received in the recessed portion 53 of the moving arm member 5 in the first position, the handlebar 62 does not extend past the seat unit 3 in the vertical direction.

Referring to FIGS. 3 through 5 again, the support frame is arranged in the second position such that the elevation difference h between the swinging portion 52 and the rotating portion 51, as well as between the seat unit 3 at the swinging portion 52 and the wheel pedal unit 2 at the rotating portion 51, is maximized in the vertical direction. In this second position, the moving arm member 5 is biased to move the rails 512 of the rotating portion 51 relative to the rail supports 42 of the base 4 to the extent where the swinging portion 52 is kept far from the fulcrum I, and wherein the stop block 513 at one end of each rail 512 is stopped against one end of the respective rail supports 42. Further, the elevation difference d between the swinging portion 52 and the rotating portion 51, as well as between the seat unit 3 at the swinging portion 52 and the wheel pedal unit 2 at the rotating portion 51, is minimized in the horizontal direction when the support frame is arranged in the second position. Thus, by means of moving the handle assembly 6 to the second position and adjusting the seat unit 3 to a proper angle, the user can sit on the seat unit 3 in the normal upright sitting posture and hold the grips 621 located in front of the seat unit 3. Accordingly, the user can also then pedal the wheel pedal unit 2 which is located below the seat unit 3.

Referring to FIGS. 6 and 7, the support frame is shown in the first position such that the moving arm member 5 is biased to move the rails 512 of the rotating portion 51 relative to the rail supports 42 of the base 4 to the extent where the swinging portion 52 is located in closer proximity to the base 4, and the stop block 513 at the other end of each rail 512 is stopped against the other end of the respective rail support 42. At this first position, the elevation difference h between the swinging portion 52 and the rotating portion 51, as well as between the seat unit 3 at the swinging portion 52 and the wheel pedal unit 2 at the rotating portion 51, is minimized in the vertical direction. Further, the elevation difference d between the swinging portion 52 and the rotating portion 51, as well as between the seat unit 3 at the swinging portion 52 and the wheel pedal unit 2 at the rotating portion 51, is maximized in the horizontal direction. Thus, by means of moving the handle assembly 6 to the first position and adjusting the seat unit 3 to a proper angle, the user can sit on the seat unit 3 in the recumbent sitting posture. Because the gap between the grips 621 is larger than the width of the seat cushion 31, the user can hold the grips 621 at two opposite lateral sides at a location below the seat unit 3. The user can also then pedal the wheel pedal unit 2 which is located in front of the seat unit 3.

Figure 8:
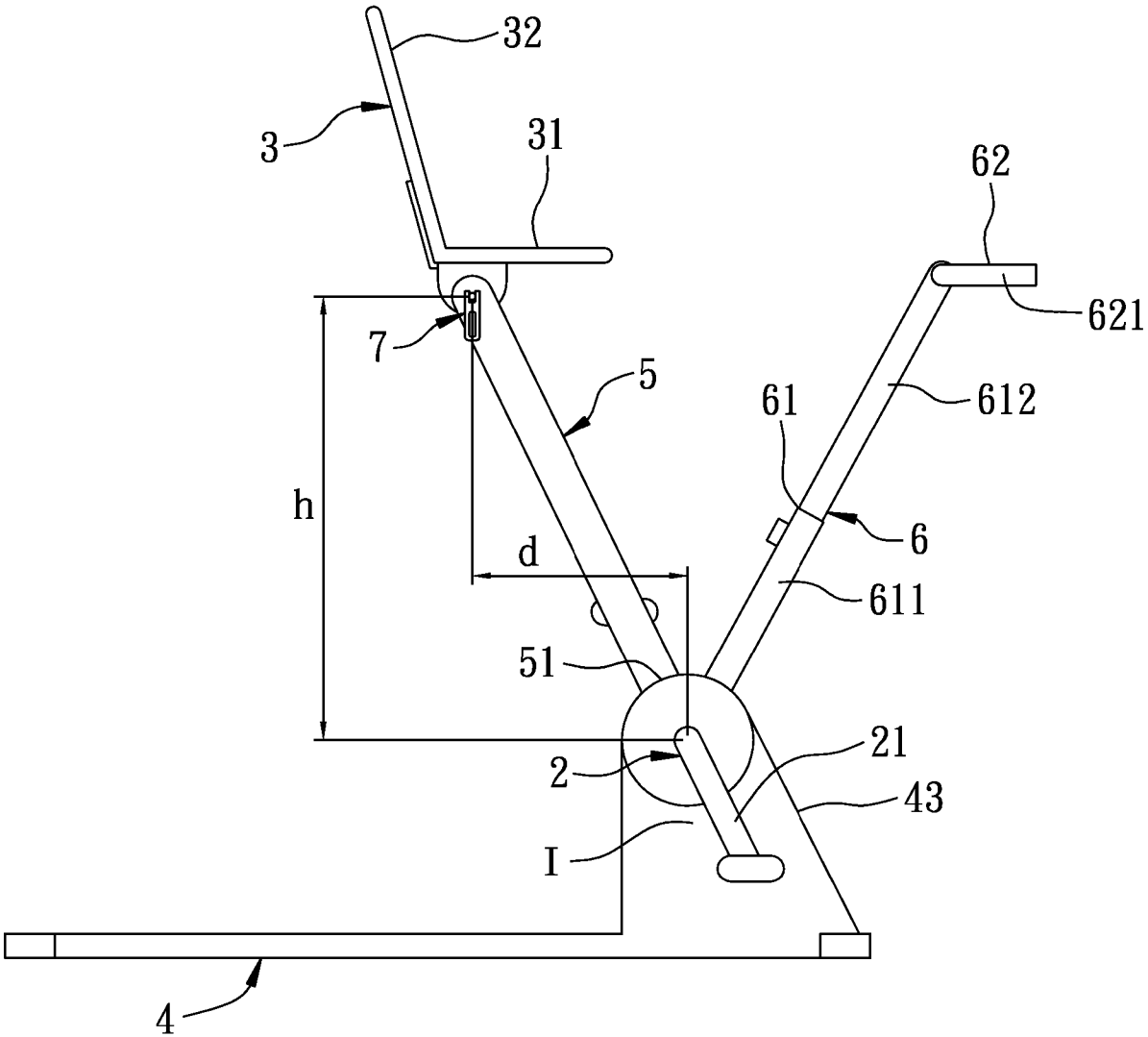
FIG. 8 is a schematic front view illustrating a support frame used in an exercise apparatus in accordance with a second embodiment of the present invention and set for a normal upright sitting exercise.
Figure 9:
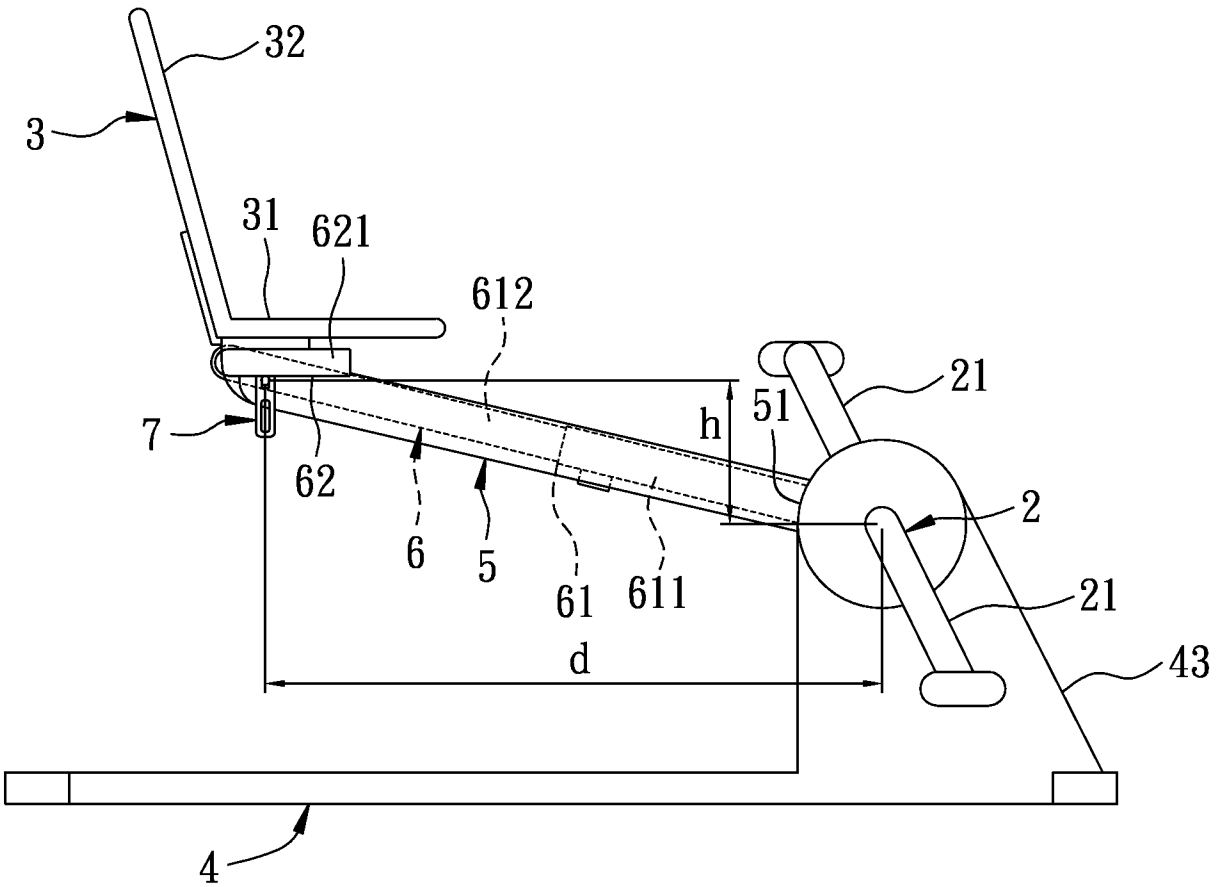
FIG. 9 is a schematic front view of the support frame shown in FIG. 8 set for a recumbent sitting exercise.

Referring to FIGS. 8 and 9, a support frame for an exercise apparatus in accordance with a second embodiment of the present invention is shown. Similar to the aforesaid first embodiment, this second embodiment is also assembled with a wheel pedal unit 2 and a seat unit 3 to constitute an exercise apparatus. This second embodiment also comprises a base 4, a moving arm member 5, a handle assembly 6, and a quick release 7. The main features of this second embodiment are outlined hereinafter.

The base 4 works as a fulcrum I, comprising an upright support 43 in which the wheel pedal unit 2 is installed. It is worth mentioning that the upright support 43 is configured in a U-shape. The wheel pedal unit 2 comprises two pedals 21 respectively pivotally mounted at two opposite lateral sides of the upright support 43.

The rotating portion 51 of the moving arm member 5 is pivotally mounted at the center of the upright support 43. Accordingly, the rotating portion 51 can be rotated on the fulcrum I, thus enabling the swinging portion 52 to swing between a high position far from the base 4 and a low position close to the base 4. Such swinging between the high and low positions changes the elevation difference h between the swinging portion 52 and the rotating portion 51 in the vertical direction, as well as the elevation difference d between the swinging portion 52 and the rotating portion 51 in the horizontal direction. Therefore, the exercise apparatus can be adjusted for enabling the user to sit on the seat unit 3 in the normal upright, or elevated, sitting posture and to hold the grips 621 in front of the seat unit 3 and to pedal the wheel pedal unit 2 below the seat unit 3. Alternatively, the exercise apparatus can be adjusted for enabling the user to sit on the seat unit 3 in a recumbent sitting posture and to hold the grips 621 at two opposite lateral sides below the elevation of the seat unit 3 and to pedal the wheel pedal unit 2 in the front side relative to the seat unit 3.

It is therefore apparent that the support frame for an exercise apparatus in accordance with the present invention has many benefits. The relative position between the wheel pedal unit 2 and the seat unit 3 can be changed by means of moving the moving arm member 5 to change the elevation difference d in the vertical direction and the elevation difference h in the horizontal direction between the first end 51 and the second end 52. Also adjusting the angular position of the seat unit 3 allows the user to sit on the seat in either the normal sitting position or the recumbent sitting position to perform a different exercise mode as desired. Thus, the simplified structure of the exercise apparatus support frame of the present invention has enhanced practicality since it facilitates operation by advantageously incorporating only one single wheel pedal unit 2 and one single seat unit 3 for performing different exercising modes.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A support frame mounted in an exercise apparatus comprising a wheel pedal unit for pedaling by the legs of a user and a seat unit for the sitting of the user using the exercise apparatus, the support frame comprising:

a base having at least one fulcrum;

a moving arm member comprising a rotating portion located at one end thereof and rotatably supported on said at least one fulcrum of said base, and a swinging portion located at an opposite end thereof, said rotating portion having said wheel pedal unit installed therein, said swinging portion having said seat unit installed therein, said swinging portion being swingable on a center of said rotating portion and configured to swing between a high position and a low position to change the distance difference between said seat unit and said wheel pedal unit in both a vertical direction and a horizontal direction; and a handle assembly pivotally connected directly to the rotating portion of the moving arm member; wherein said base comprises a body, and two rail supports located at a top side of said body and spaced apart from each other at a predetermined distance to form said at least one fulcrum; said rotation portion of said moving arm member comprises an arched wall extending around an axis and two rails extending along said arched wall and respectively slidably coupled to said rail supports.

2. The support frame as claimed in claim 1, wherein said moving arm member further comprises four stop blocks respectively located at each of two opposite ends of each of said two rails for stopping against said rail supports when said swinging portion reaches one of said high position and said low position.

3. The support frame as claimed in claim 1, wherein the handle assembly is biasable relative to said moving arm member between a first position where said handle assembly is attached to said moving arm member and a second position where said handle assembly defines a predetermined contained angle with said moving arm member.

4. The support frame as claimed in claim 3, wherein said moving arm member comprises a recessed portion facing toward and fitting said handle assembly; said handle assembly comprises a retractable support pivotally connected to said rotating portion of said moving arm member, and a handlebar connected to said retractable support, said retractable support being receivable in said recessed portion of said moving arm member.

5. The support frame as claimed in claim 4, wherein said retractable support of said handle assembly comprises a sleeve pivotally connected to said rotating portion of said moving arm member, and an inner bar movable in and out of said sleeve and connected to said handlebar.

6. The support frame as claimed in claim 4, wherein said handlebar comprises two backwardly extending grips, said two backwardly extending grips defining therebetween a gap larger than the width of a seat cushion so that said two backwardly extending grips are disposed at two opposite lateral sides relative to said seat unit when said handle assembly is in said first position.

7. The support frame as claimed in claim 1, wherein said swinging portion of said moving arm member comprises a connection means located at one end thereof; said seat unit comprises a mounting portion located at a bottom side thereof and pivotally coupled to said connection means.

8. The support frame as claimed in claim 7, wherein said connection means includes a recess; said mounting portion is a protruded member pivotally coupled to said recess.

9. The support frame as claimed in claim 8, further comprising a quick release pivotally inserted through said connection means and said mounting portion and operable to lock said connection means and said mounting portion in place.

10. The support frame as claimed in claim 1, wherein when said seat unit is moved with said swinging portion of said moving arm member far from said base, the distance difference between said swinging portion and said rotating portion is maximized in the vertical direction and minimized in the horizontal direction; and when said seat unit is moved with said swinging portion of said moving arm member toward said base, the distance difference between said swinging portion and said rotating portion is minimized in the vertical direction and maximized in the horizontal direction.

11. A support frame mounted in an exercise apparatus comprising a wheel pedal unit for pedaling by the legs of a user and a seat unit for the sitting of the user using the exercise apparatus, the support frame comprising:

a base comprising an upright working as a fulcrum, said upright having said wheel pedal unit installed therein;

a moving arm member comprising a rotating portion located at one end thereof and pivotally coupled to said upright support and a swinging portion located at an opposite end thereof, said rotating portion being rotatably supported on said fulcrum of said upright support, said swinging portion having said seat unit installed therein, said swinging portion being swingable on a center of said rotating portion between a high position located far from said base and a low position located close to said base to change the distance difference between said seat unit and said wheel pedal unit in both a vertical direction and a horizontal direction; and a handle assembly pivotally connected directly to the rotating portion of the moving arm member.

12. The support frame as claimed in claim 11, wherein the handle assembly is biasable relative to said moving arm member between a first position where said handle assembly is attached to said moving arm member and a second position where said handle assembly defines a predetermined contained angle with said moving arm member.

13. The support frame as claimed in claim 12, wherein said moving arm member comprises a recessed portion located at one side thereof and facing toward and fitting said handle assembly; said handle assembly comprises a retractable support pivotally connected to said rotating portion of said moving arm member, and a handlebar connected to said retractable support, said retractable support being receivable in said recessed portion of said moving arm member.

14. The support frame as claimed in claim 13, wherein said retractable support of said handle assembly comprises a sleeve pivotally connected to said rotating portion of said moving arm member, and an inner bar movable in and out of said sleeve and connected to said handlebar.

15. The support frame as claimed in claim 14, wherein said handlebar comprises two backwardly extending grips, said two backwardly extending grips defining therebetween a gap larger than the width of a seat cushion so that said two backwardly extending grips are disposed at two opposite lateral sides relative to said seat unit when said handle assembly is in said first position.

16. The support frame as claimed in claim 11, wherein said swinging portion of said moving arm member comprises a connection means located at one end thereof; said seat unit comprises a mounting portion located at a bottom side thereof and pivotally coupled to said connection means.

17. The support frame as claimed in claim 16, wherein said connection means includes a recess; said mounting portion is a protruded member pivotally coupled to said recess.

18. The support frame as claimed in claim 16, further comprising a quick release pivotally inserted through said connection means and said mounting portion and operable to lock said connection means and said mounting portion in place.

19. The support frame as claimed in claim 11, wherein when said seat unit is moved with said swinging portion of said moving arm member far from said base, the distance difference between said swinging portion and said rotating portion is maximized in the vertical direction and minimized in the horizontal direction; and when said seat unit is moved with said swinging portion of said moving arm member toward said base, the distance difference between said swinging portion and said rotating portion is minimized in the vertical direction and maximized in the horizontal direction.

* * * * *